US006513703B2

(12) United States Patent
Becker

(10) Patent No.: US 6,513,703 B2
(45) Date of Patent: Feb. 4, 2003

(54) PACKING SYSTEM FOR PERISHABLE GOODS

(75) Inventor: John W. Becker, Gardena, CA (US)

(73) Assignee: Victory Packaging, Inc., Houston, TX (US)

( * ) Notice: Subject to any disclaimer, the term of this patent is extended or adjusted under 35 U.S.C. 154(b) by 45 days.

(21) Appl. No.: 09/822,526

(22) Filed: Apr. 2, 2001

(65) Prior Publication Data

US 2002/0139834 A1 Oct. 3, 2002

(51) Int. Cl.[7] ..... B65D 5/62

(52) U.S. Cl. ..... 229/103.11; 220/62.2; 220/592.25; 220/592.21; 229/5.84; 229/164.1; 229/939

(58) Field of Search ..... 229/5.84, 87.18, 229/103.11, 164.1, 939; 206/521; 220/62.2, 592.2, 592.21, 592.25, FOR 128, FOR 130, FOR 153, FOR 155, FOR 173

(56) References Cited

U.S. PATENT DOCUMENTS 4,434,890 A * 3/1984 Sieck et al. ..... 220/592.25
4,889,252 A * 12/1989 Rockom et al. ..... 229/103.11
4,928,847 A * 5/1990 Hollander et al. ..... 229/103.11
5,125,566 A * 6/1992 Deiger ..... 229/103.11
5,314,087 A * 5/1994 Shea ..... 229/103.11
5,609,293 A * 3/1997 Wu et al. ..... 229/939
5,820,268 A 10/1998 Becker et al.
6,007,467 A 12/1999 Becker et al.
6,080,096 A 6/2000 Becker et al.
6,119,928 A * 9/2000 Lasson et al. ..... 229/5.84
6,296,134 B1 * 10/2001 Cardinale ..... 220/62.21

OTHER PUBLICATIONS

The Wiley Encyclopedia of Packaging Technology, John Wiley & Sons, p. 457 (1986).*

* cited by examiner

*Primary Examiner*—Gary E. Elkins
(74) *Attorney, Agent, or Firm*—Charles H. Thomas

(57) ABSTRACT

A collapsible shipping container for perishable goods is comprised of an inner, stiff, corrugated paperboard box having interior surfaces forming an enclosure of defined shape and opposing exterior surfaces. A surrounding skin of thermally insulating material is adhesively secured to the exterior surfaces of the corrugated paperboard box. The thermally insulating skin envelopes the box therewithin. Unlike conventional systems, the thermally insulating skin is located on the outside surfaces of the box, and not within the box. A collapsible shipping container according to the invention to a large extent prevents heat from ever entering the box.

9 Claims, 7 Drawing Sheets

PACKING SYSTEM FOR PERISHABLE GOODS

BACKGROUND OF THE INVENTION

1. Field of the Invention

The present invention relates to a thermally insulating system for packaging perishable goods, particularly perishable food products.

2. Description of the Prior Art

Various types of container systems have been utilized to package perishable goods, such as perishable food products. The packaging of food products for shipment in compartmentalized containers presents several problems, the solutions to which are sometimes in conflict. It is highly desirable for perishable food to be shipped in containers that provide a high degree of cushioning to prevent damage to the food products shipped therewithin. Such damage would otherwise result from impacts to the containers that inevitably occur during loading and unloading, and also during transit on a vehicle. Unfortunately, many of the best cushioning systems are also quite bulky, and therefore, the volume required to accommodate the bulk of these cushioning systems reduces the quantity of perishable goods that can be packed within a limited volume of space.

Another problem of that exists in packaging perishable food products for shipment is that the empty containers that are used to protect the goods during shipment present a storage problem when they are not actually in use. To solve this problem I and others previously devised insulated containers for packaging commercial perishable food products which are fully collapsible so that large numbers of these containers can be stored within a compact volume. These containers and their construction are described in prior U.S. Pat. Nos. 5,820,268; 6,007,467; and 6,080,096.

I have since discovered certain shortcomings in the prior designs. Specifically, all of these prior designs involved the placement of a soft sided, thermally insulating bag within an outer, stiff-walled box. The location of the thermally insulating bag within the confines of the box allows heat to enter the box and surround the bag in the box if the box is left out in the sun or stored within an area of high ambient temperature. This inevitably leads to a rise in temperature within the bag, despite its thermal insulation. Also, the location of the bag within the box reduces the volume of space within the box that can be occupied by food products. As the thickness of the insulating walls of the bag increases, the volume within the box that can be occupied by food products decreases.

Volume within the box is also reduced due to folds created in the soft walls of the thermally insulating bag as the bag conforms to the shape of the enclosure of the box. Such folds do provide dead air spaces which are helpful for installation purposes. However, this advantage is more than offset by the deleterious thermal effect on the contents of the bag by permitting heat to pass through the walls of the box and surround the thermally-insulating bag, and by the significant increase in the volume of space within the box occupied by the bag itself, rather than the contents which the bag is designed to protect.

SUMMARY OF THE INVENTION

The present invention provides an extremely useful and simple design for a collapsible container for shipping perishable goods. Stated simply, the concept of my invention involves covering the exterior surfaces of a relatively stiff shipping box with a conforming jacket or skin that is adhesively secured to the exterior surfaces of the box.

A primary advantage of the improved shipping container of the invention is that the thermally insulating skin on the exterior surfaces of the corrugated paperboard structure located therewithin to a large extent prevents heat from entering the enclosure in which the perishable goods are stored and shipped. Unlike conventional systems that allow heat to enter a stiff-walled structure, then attempt to prevent the heat from reaching the perishable goods by providing the corrugated paperboard structure with an inner thermally insulating bag, the present invention, to a large extent, prevents heat from ever entering the enclosure of the corrugated paperboard structure. The surface of the protective skin is preferably coated with a highly reflective coating that reflects most impinging solar radiation and thus precludes heat from ever entering the confines of the protective skin. By providing an insulating barrier on the exterior of the corrugated paperboard structure rather than on the interior, a much more effective thermally insulating barrier is created.

Also, by constructing the shipping container with thermal insulation on the outsides of the stiff walls, rather than on the inside, the volume of space within the stiff walled box is increased while still maintaining the advantages of thermal insulation provided by my prior systems.

A further advantage of adhesively securing a skin or jacket to the exterior surfaces of a relatively stiff shipping box is that it is easier to make the thermally insulating material conform to the shape of the exterior wall of a box, rather than the interior. As a consequence, shipping containers of this type can be closely packed together both for use in an uncollapsed and expanded form when utilized for the shipment of perishable goods. These shipping containers also occupy less space when collapsed for storage during periods of nonuse.

In one broad aspect the present the invention may be considered to be a collapsible shipping container for perishable goods comprising an inner stiff-walled structure formed of corrugated paperboard and an outer skin comprised of thermally insulating material adhesively secured to the inner walled structure. The thermally insulating material may take several forms. For example, the thermally insulating material may be comprised of a plastic bubble packing layer faced on both sides with. plastic film layers. The inner plastic film layer is adhesively secured to the outer surfaces of the inner stiff-walled structure. The other plastic film layer is preferably an exterior layer having a light-reflective coating thereon. The coating is preferably an aluminum color that reflects visible light and infrared radiation as well. In the preferred embodiments the plastic forming the thermally insulating material is polyethylene.

Alternatively, the thermally insulating material may be comprised of a plastic foam layer faced on one side with a plastic film layer. The film layer may have a light-reflective coating while the foam layer may be formed of polyethylene or polyurethane. In still another embodiment the thermally insulating material may be comprised solely of a sheet of light-reflective polyethylene.

In any event, in the thermally insulating material forming the outer skin completely covers the exterior surfaces of the inner, stiff-walled corrugated paperboard structure. While in a flattened condition the exterior surfaces of the corrugated paperboard structure are sprayed with an adhesive and then the outer thermally insulating skin is laid upon the adhesively coated corrugated paperboard structure so that the skin and the paperboard are adhesively secured together throughout their surfaces of mutual contact.

In another broad aspect the invention may be considered to be a shipping container for perishable goods comprising: a stiff walled inner liner forming an enclosure of defined shape and fabricated from corrugated paperboard with outwardly facing surfaces and an overlying jacket formed of thermally insulating material and having an inwardly facing surface that resides in contact with and is adhesively secured to the outwardly facing surfaces of the inner liner.

In still another aspect the invention may be considered to be a collapsible shipping container for perishable goods comprising: an inner, stiff, corrugated paperboard box having interior surfaces forming an enclosure of defined shape and opposing exterior surfaces, and a surrounding skin of thermally insulating material adhesively secured to the exterior surfaces to envelop the box therewithin.

The invention may be described with greater clarity and particularity by reference to the accompanying drawings.

DESCRIPTION OF THE EMBODIMENTS

Figure 1:
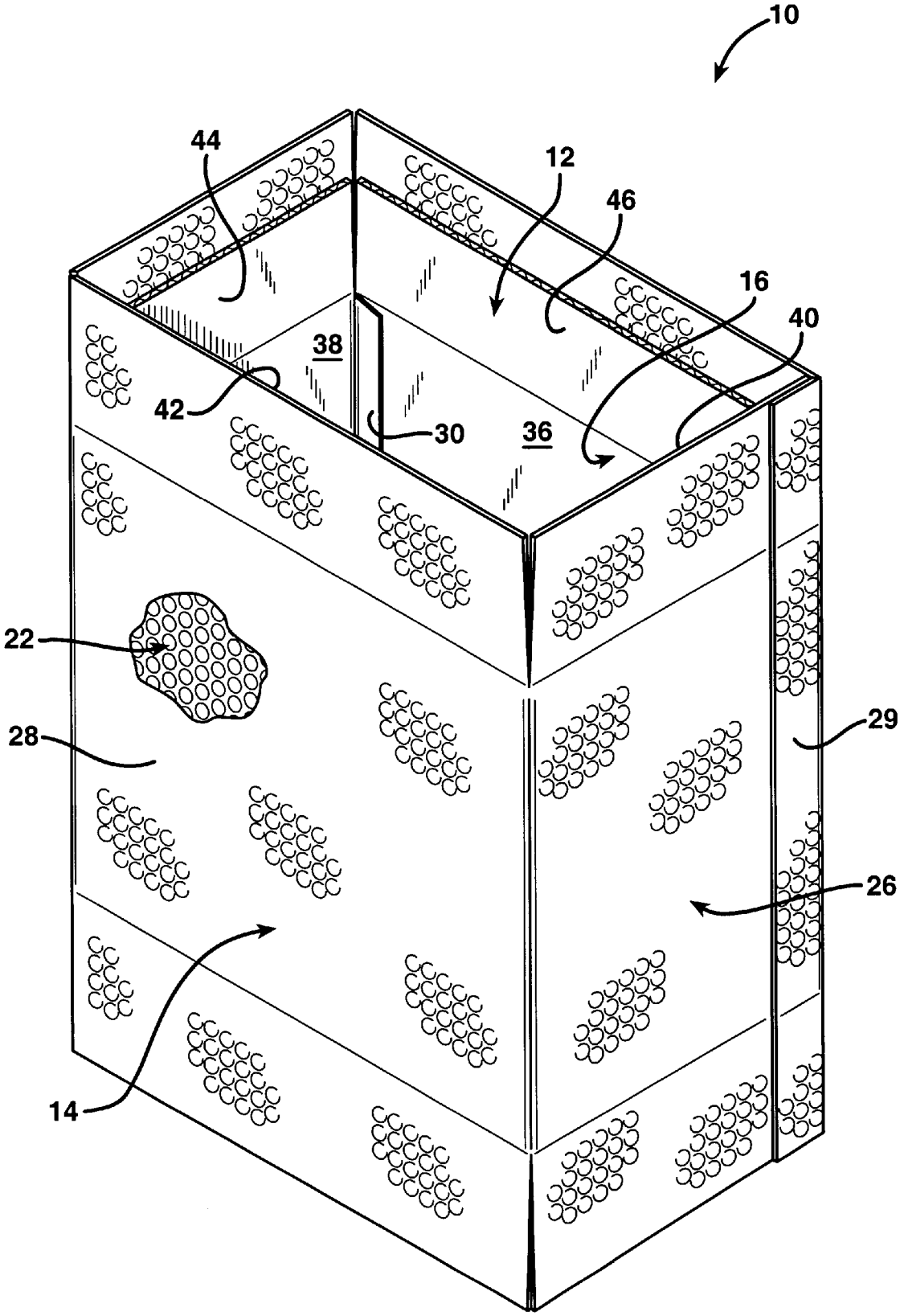
FIG. 1 is a perspective view of one preferred embodiment of the invention shown prior to closing the ends of the structure.
Figure 4:
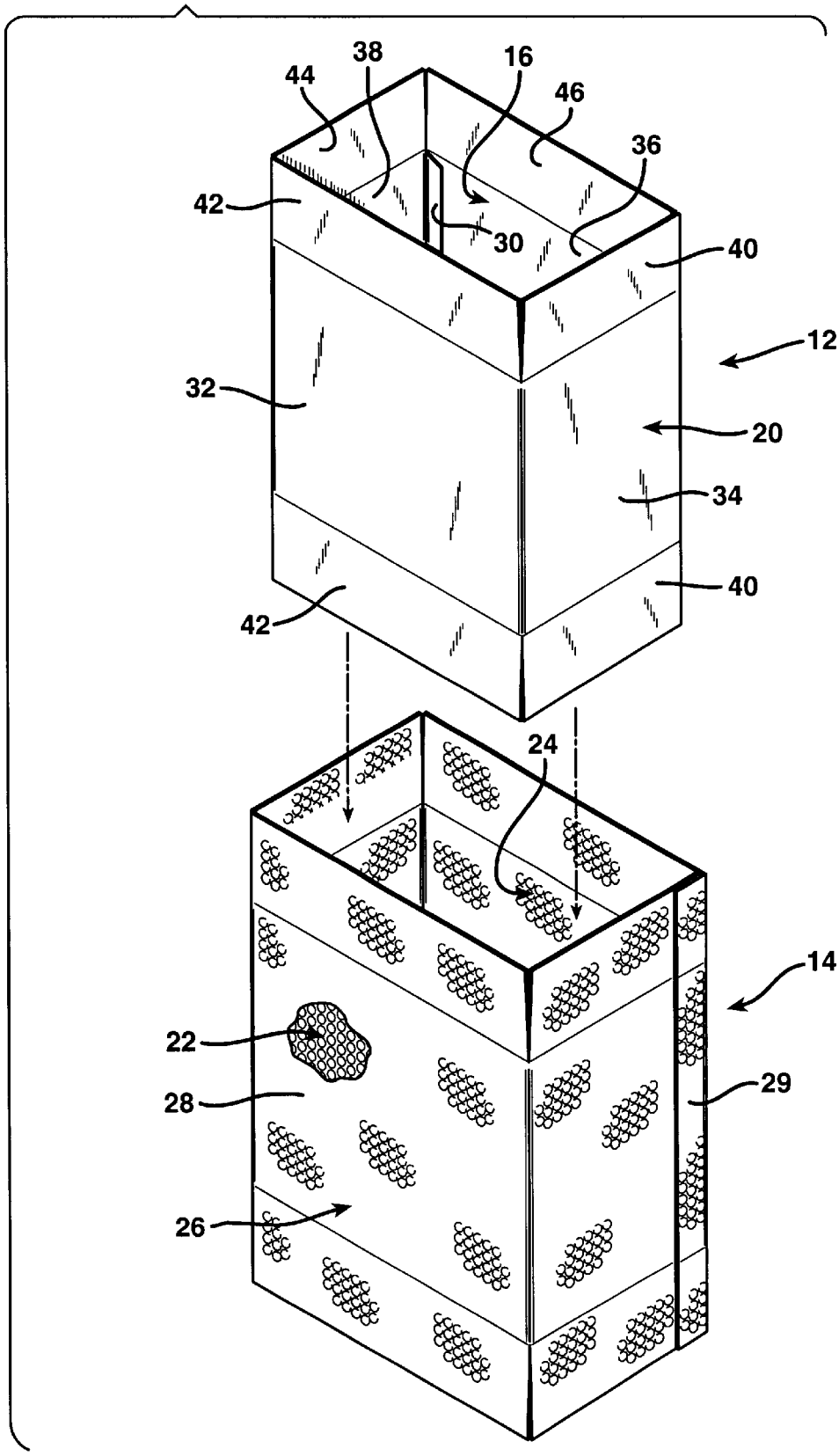
FIG. 4 is an exploded perspective view illustrating the component parts of the collapsible shipping container of FIG. 1.

FIG. 1 illustrates a collapsible shipping container 10 the ends of which have not yet been closed. The shipping container 10 is designed to accommodate perishable food products, such as fruit. With reference to FIG. 4, the shipping container 10 is comprised of an inner stiff-walled structure 12 formed of corrugated paperboard and an outer skin 14 comprised of thermally insulating material adhesively secured to the inner walled structure 12.

Figure 8:
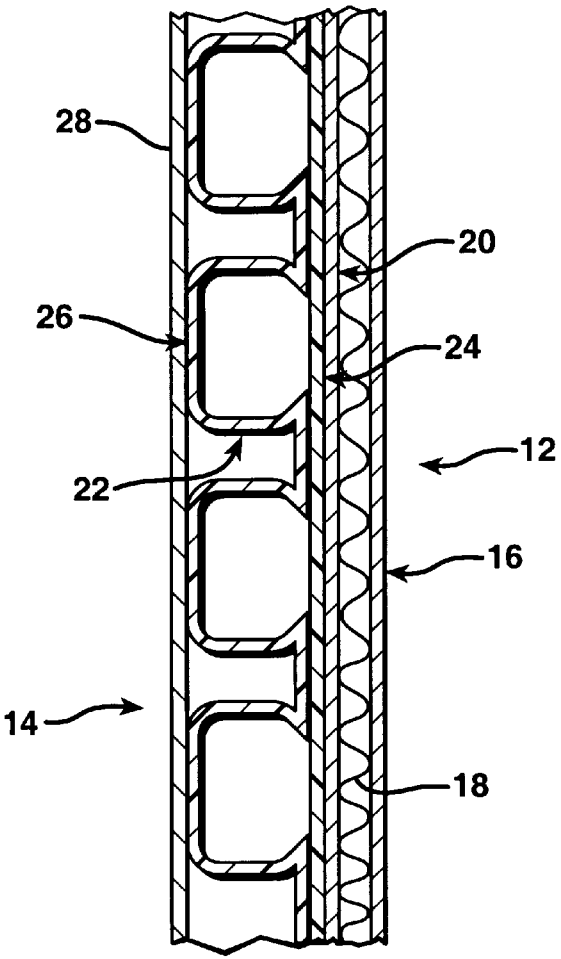
FIG. 8 is a detail section illustrating the layers of construction of the collapsible shipping container of FIGS. 1–7.

The details of the several layers that form the shipping container 10 are illustrated in FIG. 8. Specifically, the inner stiff-walled structure 12 is formed throughout of corrugated paperboard that includes a flat, smooth inner sheet-like layer of paper 16, a corrugated central layer of paper 18, and a flat outer layer of paper 20. In fabricating the inner stiff-walled paperboard structure 12, the mutually facing surfaces of the two flat layers 16 and 20 are sprayed with adhesive and the corrugated layer 18 is sandwiched therebetween. The spaced corrugations formed by the corrugated layer 18 that is secured to and confined between the flat layers 16 and 20 provide a relatively stiff, sturdy shipping container structure which is quite light in weight. The corrugated paperboard structure 12 is conventional and shipping cartons of this type have been utilized extensively in commerce for decades.

The thermally insulating skin 14 may have several different forms of construction. For example, and in one preferred embodiment of the invention, the thermally insulating material forming the skin 14 is comprised of a plastic core layer 22 which is permanently deformed to form a multiplicity of generally disc-shaped, air filled plastic bubbles. The plastic bubble packing core layer 22 is faced on both sides with flat, smoother sheets of plastic film layers 24 and 26 that are fused to the core layer 22 that forms the plastic bubbles. The flat layer 24 forming the corrugated paperboard liner 12 serves as an inner layer, while the opposing flat layer 26 serves as an outer layer.

The outer surface 28 of the outer plastic layer 26 is coated with a highly light-reflective material, such as an aluminum colored coating. The reflective coating on the outer surface 28 of the outer plastic layer 26 of the thermally insulating skin 14 functions as a highly effective reflective barrier to the rays of the sun. The insulating skin 14 may have a wall thickness of about one-eighth of an inch as measured between the inner surface of the film layer 24 that faces the stiff-walled structure 12 and the opposing outer surface 28 of the outer film layer 26. All of the plastic layers 22, 24, and 26 maybe formed of polyethylene plastic, for example.

The thermally insulating skin 14 of the collapsible shipping container 10 is secured to the outer layer 20 of the corrugated paperboard structure 12 by spraying the exposed, outer surface of the layer 20 of the paperboard structure 12 with adhesive, and then pressing the inner layer 24 of the thermally insulating skin 14 into contact with the adhesive before the adhesive can cure. The entire exposed outer surface of the paper layer 20 is sprayed with adhesive, so that the exposed outer surface of the outer layer 20 of the paperboard structure is covered throughout with adhesive and is adhesively bound throughout to the inner surface of the plastic layer 24 of the skin 14, except at a longitudinally extending box wall closure strip 30 of the paperboard structure 12, one end of which is visible in FIGS. 1 and 4. A longitudinally extending edge margin 29 of the thermally insulating skin 12 extends laterally beyond one edge of the corrugated structure that forms the stiff-walled box 12. Preferably, the thermally insulating skin 14 also extends longitudinally slightly beyond the extremities of the stiff, inner corrugated paperboard structure 12 beyond the ends thereof, as illustrated in FIG. 1.

After the adhesive has cured, the corrugated paperboard structure 12 with the thermally insulating skin 14 permanently bonded thereto is folded into a rectangular tubular shape. At one of its longitudinal edges, the corrugated paperboard structure 12 has a longitudinally extending box wall closure strip 30. The adjoining longitudinal edges of the paperboard structure 12 are secured together by the closure strip 30 in a conventional manner. Because the inner plastic layer 24 of the thermally insulating skin 14 is adhesively secured throughout to the outwardly facing surface of the paper layer 20, the thermally insulating skin 14 is totally and permanently secured to the outer surface of the stiff, corrugated paperboard structure 12.

The corrugated paperboard structure 12 is folded to define four rectangular wall panels 32, 34, 36, and 38. The longitudinal box wall closure strip 30 that adjoins one of the side wall panels 38 is adhesively secured to the inner surface of the edge of the adjoining wall panel 36 of the corrugated paperboard structure 12 so that the structure 12 initially forms an elongated, rectangular tube, as illustrated in FIGS. 1 and 4. The edge margin 29 of the outer thermally insulating skin 14 overlies and is adhesively secured to an adjoining strip of the insulating skin 14 when the structure is laterally enclosed as illustrated in FIGS. 1, 4, 6, and 7. Because the inner plastic layer 24 of the thermally insulating skin 14 is adhesively secured to the outwardly facing surface of the outer corrugated paperboard layer 20, it must follow the outer contour of the paperboard carton 12 enveloped therewithin. The thermally insulating skin 14 therefore likewise forms a rectangular-shaped tube, as illustrated in FIG. 4. Beyond the box wall closure strip 30 of the paperboard carton 12, longitudinal demarcations are defined at both ends of the rectangular tube to form end flaps 40, 42, 44, and 46 at both ends of the tubular structure 12.

FIG. 4 illustrates the inner corrugated paperboard structure 12 and the outer thermally insulating skin 14 as they would appear if separated from each other. However, it is to be understood that the thermally insulating skin 14 is adhesively and permanently secured throughout its inner surface to the outer surface of the rectangular wall panels 32, 34, 36, and 38 and also to the end flaps 40, 42, 44, and 46 of the corrugated paperboard structure 12 confined therewithin. Thus, the thermally insulating skin 14 does not form a sleeve that is removable from the rectilinear corrugated paperboard structure 12. Rather, it forms a jacket or outer casing permanently secured to the outwardly facing surfaces of all of the wall panels and end flaps of the inner, corrugated paperboard structure 12.

Figure 6:
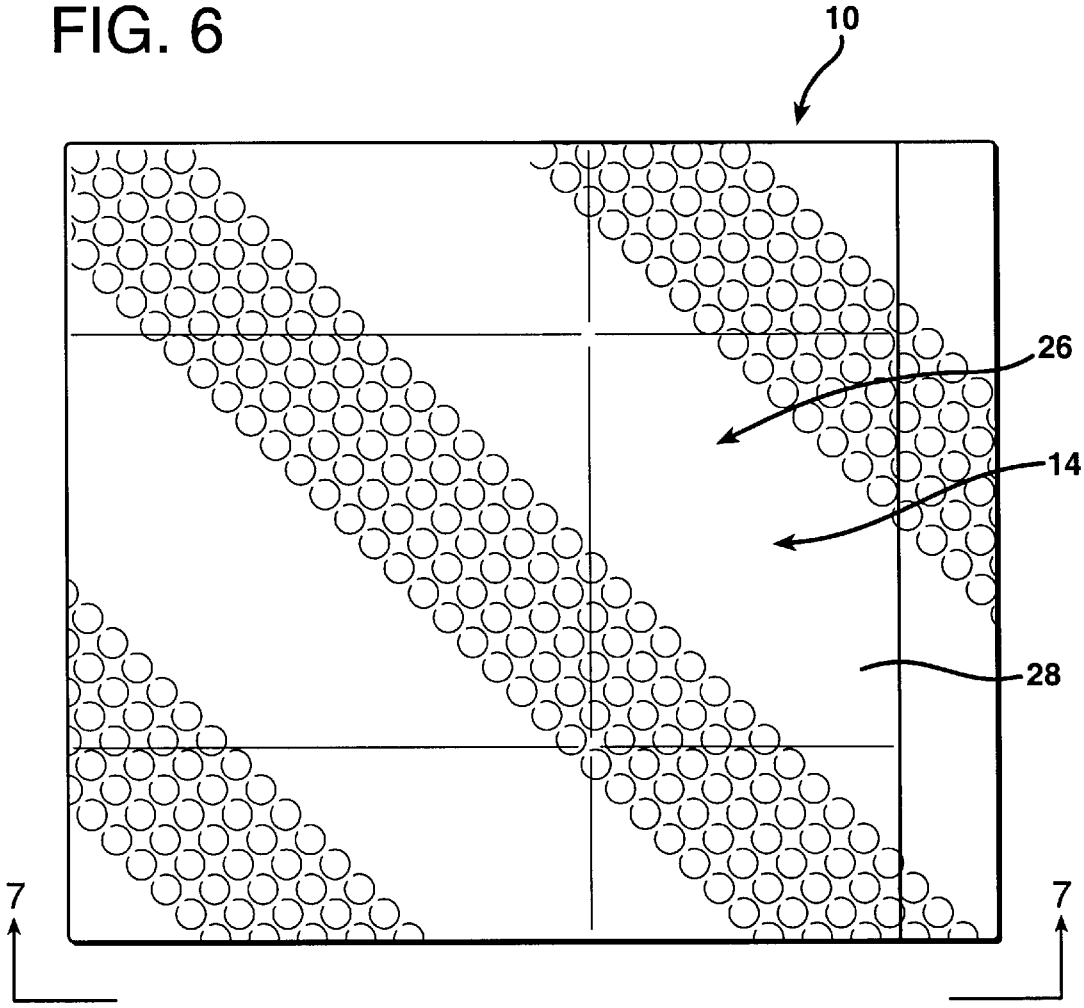
FIG. 6 illustrates the shipping container of FIG. 1 in a substantially collapsed condition.
Figure 7:
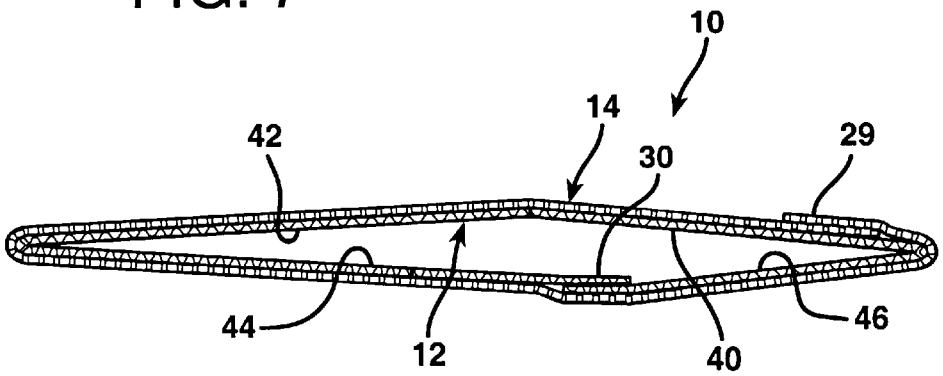
FIG. 7 is an end view taken along the lines 7—7 of FIG. 6.

FIGS. 6 and 7 illustrate the collapsible shipping container 10 in a substantially collapsed condition. While in this condition, a large number of collapsed shipping containers 10 may be stacked flat, one atop another to minimize the volume of storage space required. As is evident from FIGS. 6 and 7, a very large number of collapsed shipping containers 10 may be stacked with the inner surfaces of the inner layer 16 of the several wall panels and end flaps of the inner stiff walled liner 12 residing in contact with each other.

Figure 2:
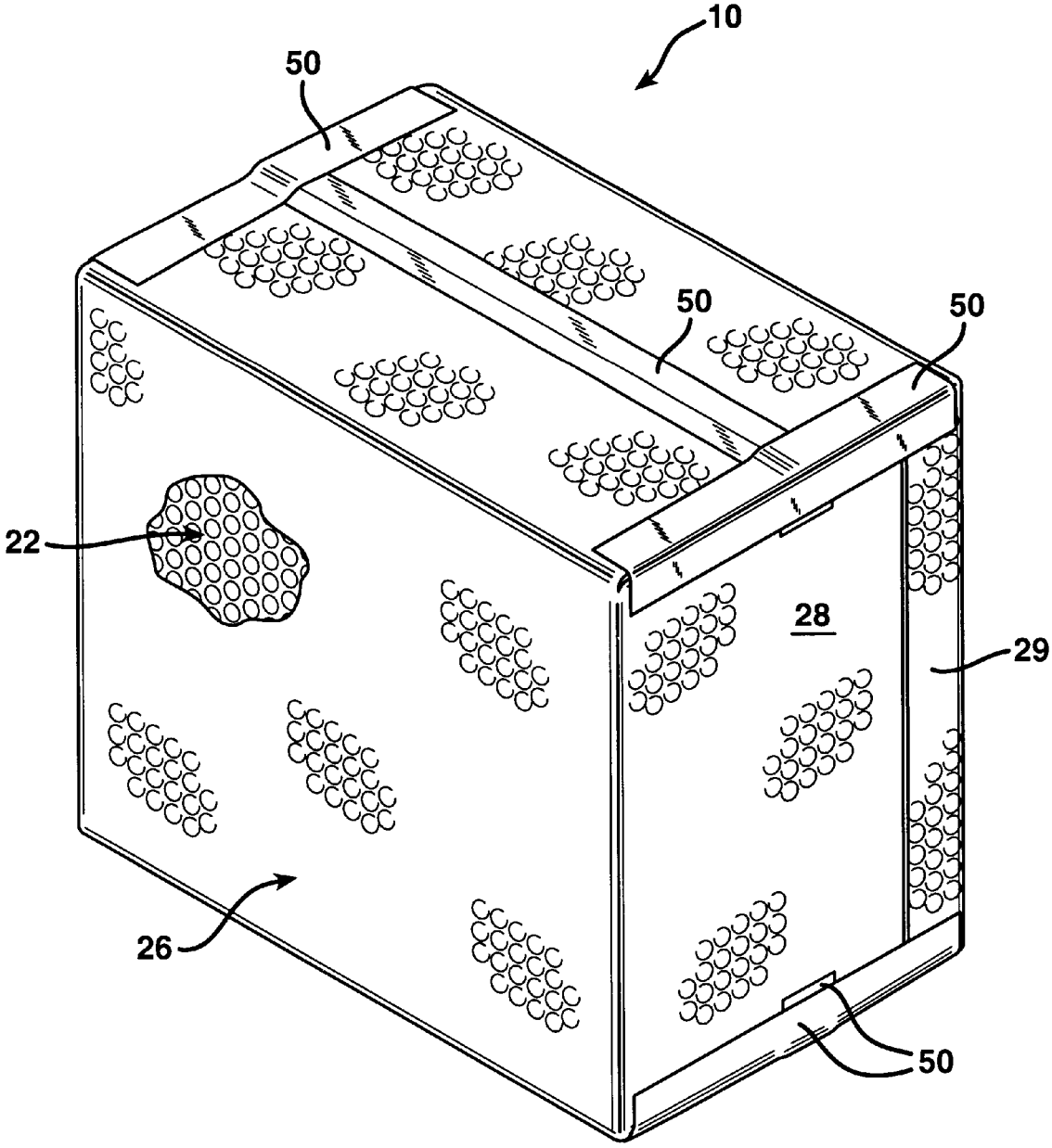
FIG. 2 is a perspective view illustrating the collapsible shipping container of FIG. 1 once the ends have been closed and sealed.
Figure 3:
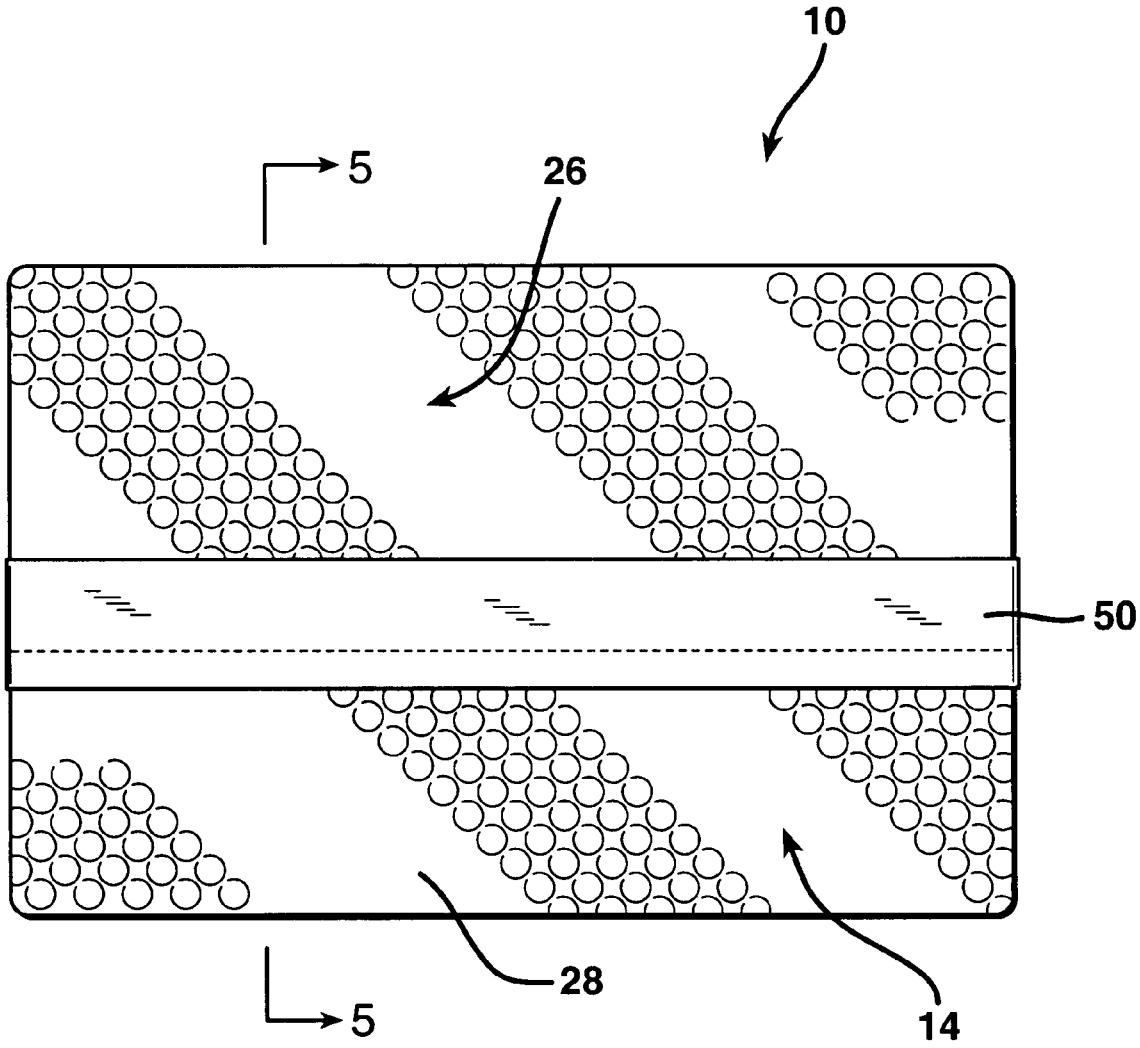
FIG. 3 is a top plan view of the closed shipping container of FIG. 2.
Figure 5:
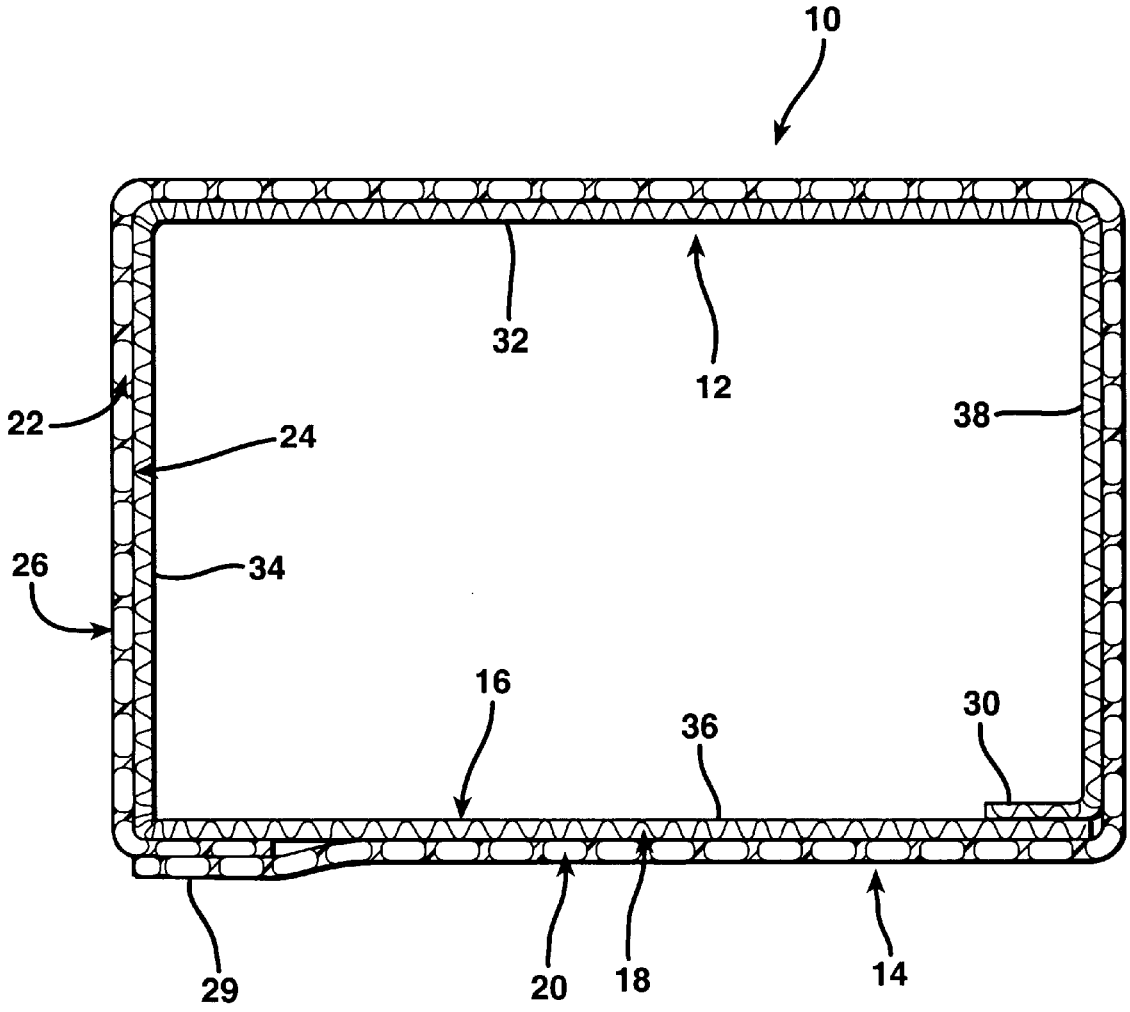
FIG. 5 is a sectional elevational view taken along the lines 5—5 of FIG. 3.

To deploy the shipping container 10 for use, the wall panels forming the inner corrugated paperboard structure 12 are laterally extended from the flattened condition illustrated in FIG. 7 to the fully rectilinear condition illustrated in FIG. 1. The end panels 40, 42, 44, and 46 of the bottom end of the shipping container 10 are then folded in toward each other and secured by lengths of transparent adhesive tape 50, as illustrated in FIGS. 2, 3, and 5.

Perishable cargo to be shipped is then placed within the rectilinear cavity defined within the inwardly facing surface of the inner paperboard layer 16 at the wall panels and bottom end flaps. The top end flaps 40, 42, 44, and 46 are then folded over and secured with lengths of transparent tape 50. The tape lengths 50 are preferably all transparent so that all of the visible exterior surfaces of the closed shipping container 10 are preferably covered with a highly light-reflective film. The only externally exposed surface of the shipping container 10 is the outer surface 28 of the outer plastic layer 26 that is covered with the reflective coating.

As a consequence, and unlike conventional shipping containers for perishable goods, the container 10 is totally covered with an outer, thermally insulating material, namely the thermally insulating skin or jacket 14. By constructing the shipping container 10 in this manner, the rays of the sun and heat from the surrounding environment are, to a very great extent, reflected before they are able to enter the confined cavity of the stiff, inner walled, corrugated paperboard structure 12. The perishable goods located within the enclosure of the shipping container 10 are thereby protected from the degrading effects of the sun and from either excessive heat or excessive cold to a much greater extent than is the case with conventional shipping containers for perishable goods.

Figure 9:
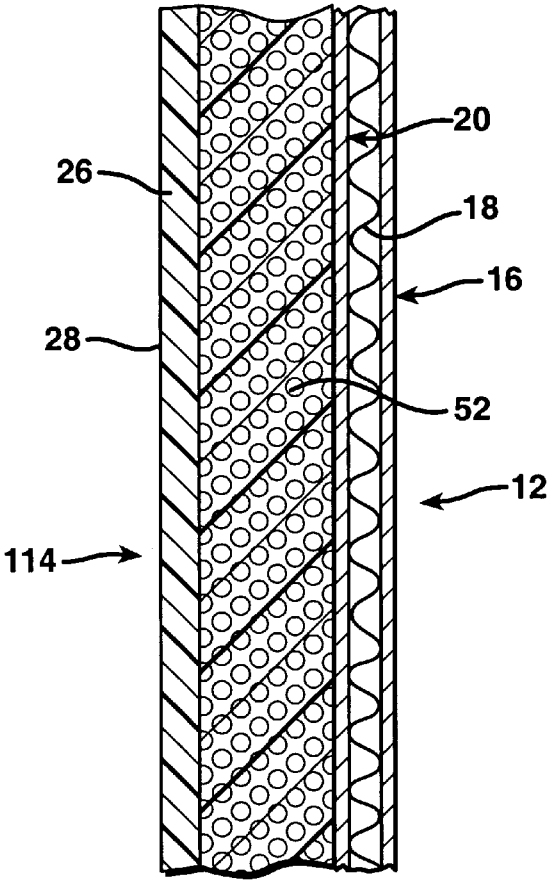
FIG. 9 is a sectional detail illustrating an alternative form of construction of a shipping container according to the invention.

While the thermally insulating skin 14 is formed of a bubble packing layer 22 faced on both sides with plastic film layers 24 and 26, the thermally insulating skin may be constructed of other materials as well. For example, FIG. 9 illustrates an alternative construction of a collapsible shipping container in which the surrounding thermally insulating skin 114 is constructed of an inner layer of polyethylene or polyurethane foam 52 and an outer layer 26 having an outer, exposed surface 28 covered with a highly light-reflective coating, as in the embodiment of FIG. 8. In the embodiment of FIG. 9 the foam layer 52 provides thermal protection in a manner comparable to the bubble pack core layer 22 in the embodiment of FIG. 8.

Figure 10:
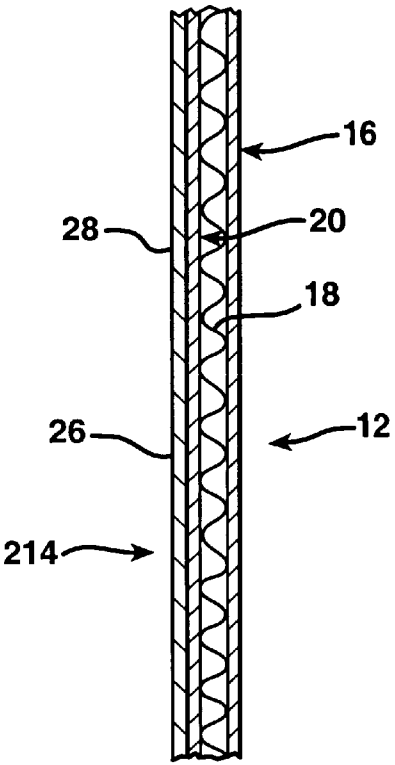
FIG. 10 is a sectional detail illustrating still another form of construction of a shipping container according to the invention.

FIG. 10 illustrates still another embodiment of the invention in which the outer, protective skin 214 is formed solely of a layer 26 of polyethylene film having an outer surface 28 covered with a highly light-reflective, aluminum colored coating. The outer skin 214 in the embodiment of FIG. 10 does not provide as much thermal insulation as either the polyethylene bubble pack skin 14 shown in FIG. 8 or the foam lined skin 114 shown in FIG. 9. However, the skin 214 in the embodiment of FIG. 10 does provide a very effective reflective barrier to the rays of the sun, and is suitable for use in many applications in which extreme temperatures are not likely to be encountered.

Undoubtedly, numerous variations and modifications of the invention will become readily apparent to those familiar with shipping containers utilized for perishable goods. Accordingly, the scope of the invention should not be construed as limited to the specific embodiments depicted and described, but rather is defined in the claims appended hereto.

I claim:

1. A collapsible shipping container for perishable goods comprising an inner stiff-walled structure formed of corrugated paperboard and an outer skin comprised of thermally insulating material adhesively secured to said inner walled structure, wherein said thermally insulating material is comprised of a plastic bubble packing layer faced on both sides with plastic film layers.

2. A collapsible shipping container according to claim 1 wherein one of said plastic film layers is an inner layer adhesively secured to said inner walled structure and the other of said plastic film layers is an exterior layer having a light-reflective coating thereon.

3. A collapsible shipping container according to claim 2 wherein said plastic is polyethylene.

4. A collapsible shipping container for perishable goods comprising an inner stiff-walled structure formed of corrugated paperboard and an outer skin comprised of thermally insulating material adhesively secured to said inner walled structure, wherein said thermally insulating material is comprised of a plastic foam layer faced on one side with a plastic film layer.

5. A collapsible shipping container according to claim 4 wherein said plastic film layer is polyethylene and said plastic foam layer is polyurethane.

6. A collapsible shipping container for perishable goods comprising a stiff walled inner liner forming an enclosure of defined shape and fabricated of corrugated paperboard with outwardly facing surfaces and an overlying jacket formed of thermally insulating material and having inwardly facing surfaces that reside in contact with and are adhesively secured to said outwardly facing surfaces of said inner liner, wherein said thermally insulating material is comprised of a plastic bubble packing layer faced on both sides with plastic film layers.

7. A collapsible shipping container according to claim 6 wherein one of said plastic film layers is an inner layer adhesively secured to said outwardly facing surfaces of said inner liner and the other of said plastic film layers is an exterior layer having a light-reflective coating thereon.

8. A collapsible shipping container according to claim 6 wherein said thermally insulating material is formed of polyethylene.

9. A collapsible shipping container for perishable goods comprising a stiff walled inner liner forming an enclosure of defined shape and fabricated of corrugated paperboard with outwardly facing surfaces and an overlying jacket formed of thermally insulating material and having inwardly facing surfaces that reside in contact with and are adhesively secured to said outwardly facing surfaces of said inner liner, wherein said thermally insulating material is comprised of a plastic foam layer faced on one side with a plastic film layer.

* * * * *